US009595247B2

(12) United States Patent
Benner, Jr. et al.

(10) Patent No.: US 9,595,247 B2
(45) Date of Patent: Mar. 14, 2017

(54) HEEL-TOE ACTUATED PEDAL SYSTEM

(71) Applicant: Pangolin Laser Systems, Inc., Orlando, FL (US)

(72) Inventors: William R. Benner, Jr., Longwood, FL (US); Shawn Michael Alvarez, Palm Bay, FL (US); Chelsea Dickens, Gainesville, FL (US); Lauren Berthelsen, Orlando, FL (US); Preston Johnson, Jacksonville, FL (US); Matthew Allison, Orlando, FL (US); John Rosasco, Melbourne, FL (US)

(73) Assignee: Pangolin Laser Systems, Inc., Orlando, FL (US)

( * ) Notice: Subject to any disclaimer, the term of this patent is extended or adjusted under 35 U.S.C. 154(b) by 0 days.

(21) Appl. No.: 14/977,142

(22) Filed: Dec. 21, 2015

(65) Prior Publication Data

US 2016/0189692 A1 Jun. 30, 2016

Related U.S. Application Data

(60) Provisional application No. 62/095,211, filed on Dec. 22, 2014.

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 774,539 A 11/1904 Stanton
1,508,390 A 9/1924 Gladstone et al.
(Continued)

FOREIGN PATENT DOCUMENTS

GB 2146162 A * 4/1985 ..... G10D 13/006
GB 2451860 A * 2/2009 ..... G10D 13/006

OTHER PUBLICATIONS

Cannon DP921FB Bass Drum Pedal; http://www.amazon.co.uk/Cannon-DP921F-Bass_Drum-Pedal/dp/B005FSXIOW; Feb. 6, 2014.

(Continued)

*Primary Examiner* — Robert W Horn
(74) *Attorney, Agent, or Firm* — Stephen G. Anderson; GrawRobinson, P.A.

(57) ABSTRACT

A heel-toe actuated bass drum pedal system includes a pedal having a heel hinge point at a rear portion and an opposing toe hinge point at a front portion. A heel transfer arm is connected between the heel hinge point and the base. A heel rocker pivot is connected to the base and a heel linkage connected between the heel transfer arm and the heel rocker pivot such that movement of the heel linkage provides rotational movement to the heel rocker pivot which may carry a drum beater. A toe rocker pivot is connected to the base and a toe linkage connected between the toe rocker pivot and the toe hinge point for providing the rotational movement to the toe rocker pivot which may include a second drum beater. A return spring biases the rocker pivots toward a preselected rotation.

16 Claims, 7 Drawing Sheets

(56) References Cited

U.S. PATENT DOCUMENTS

| | | | | | |
|---|---|---|---|---|---|
| 2,484,302 | A | | 10/1949 | Laverents | |
| 3,125,921 | A | * | 3/1964 | Korosh | G10D 13/006 84/411 R |
| 3,618,441 | A | | 11/1971 | Ferns | |
| 3,988,957 | A | * | 11/1976 | Escamilla | G10D 13/006 84/422.1 |
| 4,188,853 | A | * | 2/1980 | Bills | G10D 13/006 84/422.1 |
| 4,782,733 | A | * | 11/1988 | Herring | G10D 13/006 84/422.1 |
| 4,788,897 | A | | 12/1988 | Kirby et al. | |
| 4,945,803 | A | * | 8/1990 | Norwood | G10D 13/006 84/422.1 |
| 4,958,549 | A | | 9/1990 | Vukovic | |
| 5,090,289 | A | | 2/1992 | Holcomb | |
| 5,877,441 | A | * | 3/1999 | Labute | G10D 13/006 84/422.1 |
| 6,002,076 | A | * | 12/1999 | Karn | G10D 13/006 84/236 |
| 6,201,173 | B1 | * | 3/2001 | Black | G10D 13/006 84/104 |
| 6,271,450 | B1 | * | 8/2001 | Mackie | G10D 13/006 84/422.1 |
| 6,541,686 | B2 | | 4/2003 | O'Donnell | |
| 6,649,820 | B2 | | 11/2003 | Sassmannshausen | |
| 7,339,103 | B2 | * | 3/2008 | Hilburn | G10D 13/006 200/86.5 |
| 7,435,888 | B2 | * | 10/2008 | Steele | G10D 13/006 84/422.1 |
| 7,838,753 | B2 | * | 11/2010 | Steele | G10H 1/32 84/422.1 |
| 7,964,781 | B1 | * | 6/2011 | Lovvorn | G10D 13/06 84/327 |
| 7,989,688 | B2 | * | 8/2011 | Luo | G10D 13/006 84/422.1 |
| 8,344,235 | B2 | * | 1/2013 | Steele | G10H 1/348 84/422.3 |
| 8,389,848 | B1 | * | 3/2013 | Baker | G10H 1/348 84/612 |
| 2014/0090543 | A1 | | 4/2014 | Kitching | |
| 2016/0071500 | A1 | * | 3/2016 | Owen | G10D 13/006 84/422.1 |
| 2016/0189692 | A1 | * | 6/2016 | Benner, Jr. | G10D 13/006 84/422.1 |

OTHER PUBLICATIONS

Drum tec; European Electronic Drum Specialist: http://www.drum-tec.de/dp921fb-drumtec-doppelbass-mit-einem-fuss-p-262.html?language=en.

dv 247; Double Effect Single Bass Drum Pedal; http://www.dv247.com/drums-and-percussion/fame-fp9002-double-effect-single-bass-drum-pedal-202613.

Reverb w/one foot; https://reverb.com/item/319909-cannon-twin-effect-double-pedal-dp921fb-amazing-dbl-kick-w-one-foot?__aid=pla&pla=1&gclid=Cj0KEQiAn9- kBRDloNeUw7Pe__YwBEiQA4HXMUzG8Do5uJLHDkl3sblegdZVrSJIL8KoHYWVbMsTZ1boaAtpp8P8HAQ.

* cited by examiner

HEEL-TOE ACTUATED PEDAL SYSTEM

CROSS REFERENCE TO RELATED APPLICATIONS

This application claims priority to U.S. Provisional Application Ser. No. 62/095,211, the contents of which are incorporated by reference for all purposes and commonly owned.

FIELD OF INVENTION

The embodiments disclosed herein relate to percussion instruments such as a bass drum to be sounded as a result of being struck by a beater, and more specifically to percussive instrument beaters, which can be actuated using both a heel and a toe of a player's foot.

BACKGROUND

As is well known in the art, modern rock and pop music bands use multi-piece drum sets for the percussive portion of the musical performance. These drum sets are floor mounted, and are typically played by a seated drummer. Such multi-piece drum sets typically include a snare drum, several tom-toms, one or more cymbals, and a floor-mounted bass drum. Although the snare drum, tom-toms and cymbals are all sounded (actuated) as a result of being struck by sticks that drummers holds in their hands, the bass drum is actuated by a beater assembly that is triggered by a foot action. The assembly that allows a drummer to use a foot to actuate the bass drum is most often called a "bass drum pedal".

Bass drum pedals have existed for nearly a century. During most of that time period, bass drum pedals have been rather rudimentary in nature, typically including a contiguous pedal having a hinge point located near the floor, behind the heel of the drummer, and an inclining pedal, which attaches to a drum beater assembly through a linkage. Due to the inclining nature of the pedal, and where the hinge point is located, these prior art drum pedals are said to be actuated using the toe portion of the foot.

Although the hinge point for such pedals is located behind the heel, very often players do not rest their heel on the pedal while playing. Instead, they elevate their entire foot, and then raise and lower their entire leg to actuate the bass drum. This is called the "heel up" approach to playing the bass drum. The alternative approach is to keep the entire foot (including the heel) on the bass drum pedal at all times, and flex the foot toward the toe to actuate the bass drum pedal. This is called the "heel down" approach.

One problem with these prior art rudimentary pedals is that the pedal incline forces drum players to hyper-extend their foot in order to play the bass drum. The inclined orientation of the pedal is unnatural, often causing player fatigue. And although the "heel down" approach is used in virtually every other aspect of human life, it is generally uncomfortable to play in this way with prior art pedals. Because of the extended playing time, injuries to the user can result, such as shin splints when used on a regular basis and lengthy time periods.

Another problem with typical bass drum pedals is that they have a limited range of musical expression, essentially being limited to "one strike per actuation," meaning that the drum is actuated once as the foot flexes forward. This means that when the drummer wants to play the drum very quickly, it requires very quick forward-foot-flexes in succession. A typical method of getting around this limitation is to add another bass drum pedal which may be used to actuate a separate bass drum, or may be used through a linkage that allows two bass drum pedals to actuate a single bass drum (i.e. allowing the drummer to use both his left and right feet simultaneously on separate pedals). This approach eases high tempo bass drum playing, because when high tempo bass drum playing is desired, the workload can be shared among each foot to play half of the beats. While this approach does allow for a greater degree of expression, including the ability to play "flams" on the bass drum, this approach doubles the cost and complexity of the bass drum portion of the drum set. Moreover, when both of the drummer's feet are placed on bass drum pedals, one foot cannot also be used to operate a separate drum effect, such as a hi-hat pedal.

Over the years, there have been several attempts to devise improved bass drum pedals. One approach is to place the pivot point at the toe, and allow the heel to be the sole actuating aspect of the foot. This approach helps to solve the unnatural hyper-extension of the foot at the toe, but past approaches appear to be sub-optimal, and are essentially absent in the marketplace.

Another approach to devise an improved pedal is to locate the hinge point in the center of the pedal, and allow somewhat of a back-and-forth "rocker" action to actuate the bass drum with both toe and heel foot actions. While this seems to be very useful, closer study reveals that this does not allow forceful-enough actuation of the bass drum, and this approach essentially reduces the power and force of the drum player's leg.

Another approach to devise an improved pedal is to actually use two separate foot pedals on a single assembly—one pedal to be actuated by the toe in a typical fashion, and a separate pedal to be actuated by the heel. In this type of assembly, the hinge-point for the toe-actuated pedal is located near the floor, at or behind the heel. The hinge-point for the heel-actuated pedal is located under the middle of the foot. Indeed, this type of pedal has improved ergonomics and is more comfortable for players, because the heel-actuated pedal essentially elevates the heel of the player, thus getting around the hyper-extension aspect of rudimentary prior-art pedals. However, the range of expression on these pedals appears to be limited. Because of the centrally-located hinge point in the heel-actuated pedal, a virtual pivot point in the middle of the pedal is created making the feel similar to a single contiguous pedal with a central pivot point. And if the drummer wanted to perform unusual bass drum beats, such as a "flam", this is very difficult using this type of pedal.

There have been other approaches for using a single pedal with two drum beaters, and a kind of spring action that allows a single foot flex to create two separate actuated drum beats, but these approaches still locate the pivot point on the floor, behind the heel of the drummer, and use a strongly inclining pedal and toe actuation.

Therefore there remains a need for an improved bass drum pedal, one that does not require excessive hyper-extension of the foot while playing, and that also provides for a greater degree of expression while playing the drum.

SUMMARY

The teachings of the present invention are directed to a bass drum pedal that advantageously overcomes problems of known bass drum pedals by allowing a substantially-contiguous pedal to be played exclusively with toe-ward and heel-ward motions, or with both at the same time, thus allowing the greatest degree of speed and playing expression. Embodiments of the present invention alleviate player stress by locating a rest position of the pedal at a relatively slight incline instead of a steep incline as is typically used with known pedals.

By way of non-limiting example, one embodiment may comprise a pedal having a heel hinge point at a rear portion thereof and an opposing toe hinge point at a front portion thereof, wherein the front portion is dimensioned for positioning proximate a drum element. A heel transfer arm may be pivotally connected at a first end thereof to the heel hinge point of the pedal and at a second end thereof to a base. A heel rocker pivot may be rotatably connected to the base at an upstanding portion thereof and in a spaced relation to the heel transfer arm second end, and a toe rocker pivot rotatably may also be connected to the upstanding portion. A heel linkage may be pivotally connected at opposing ends thereof to the heel transfer arm and the heel rocker pivot, wherein movement of the heel linkage provides rotational movement to the heel rocker pivot for contacting the drum element. A toe linkage may be pivotally connected at opposing ends thereof to the toe rocker pivot and the toe hinge point of the pedal, wherein movement of the toe linkage provides rotational movement to the toe rocker pivot for contacting the drum element, and at least one return spring may be operable with the rocker pivots, wherein the rocker pivots are biased toward a preselected rotation.

BRIEF DESCRIPTION OF THE DRAWINGS

Embodiments of the invention are described by way of example with reference to the accompanying drawings in which.

DETAILED DESCRIPTION OF EMBODIMENTS

Figure 1:
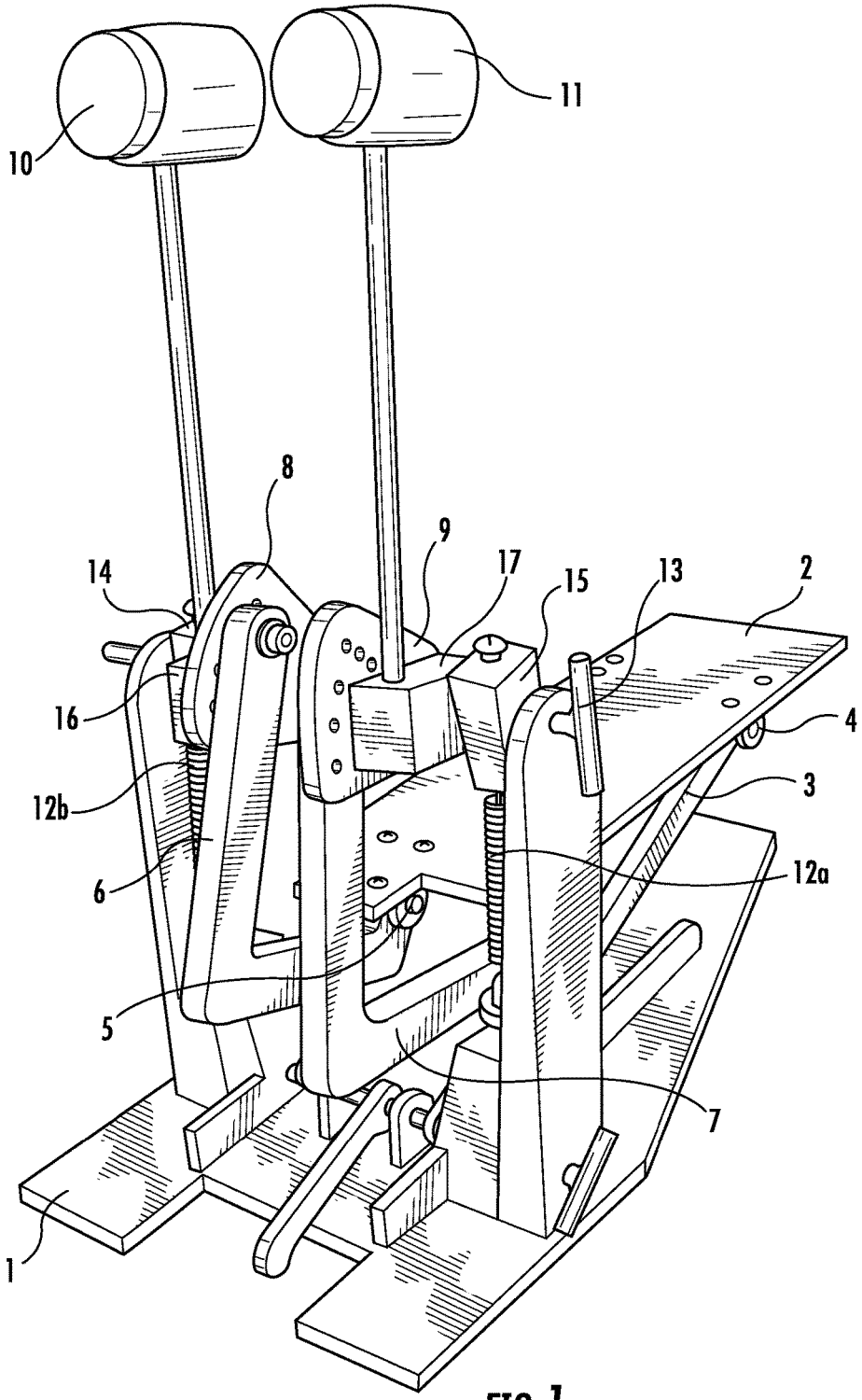
FIG. 1 is a front perspective view illustrating one embodiment of the present disclosure.
Figure 2:
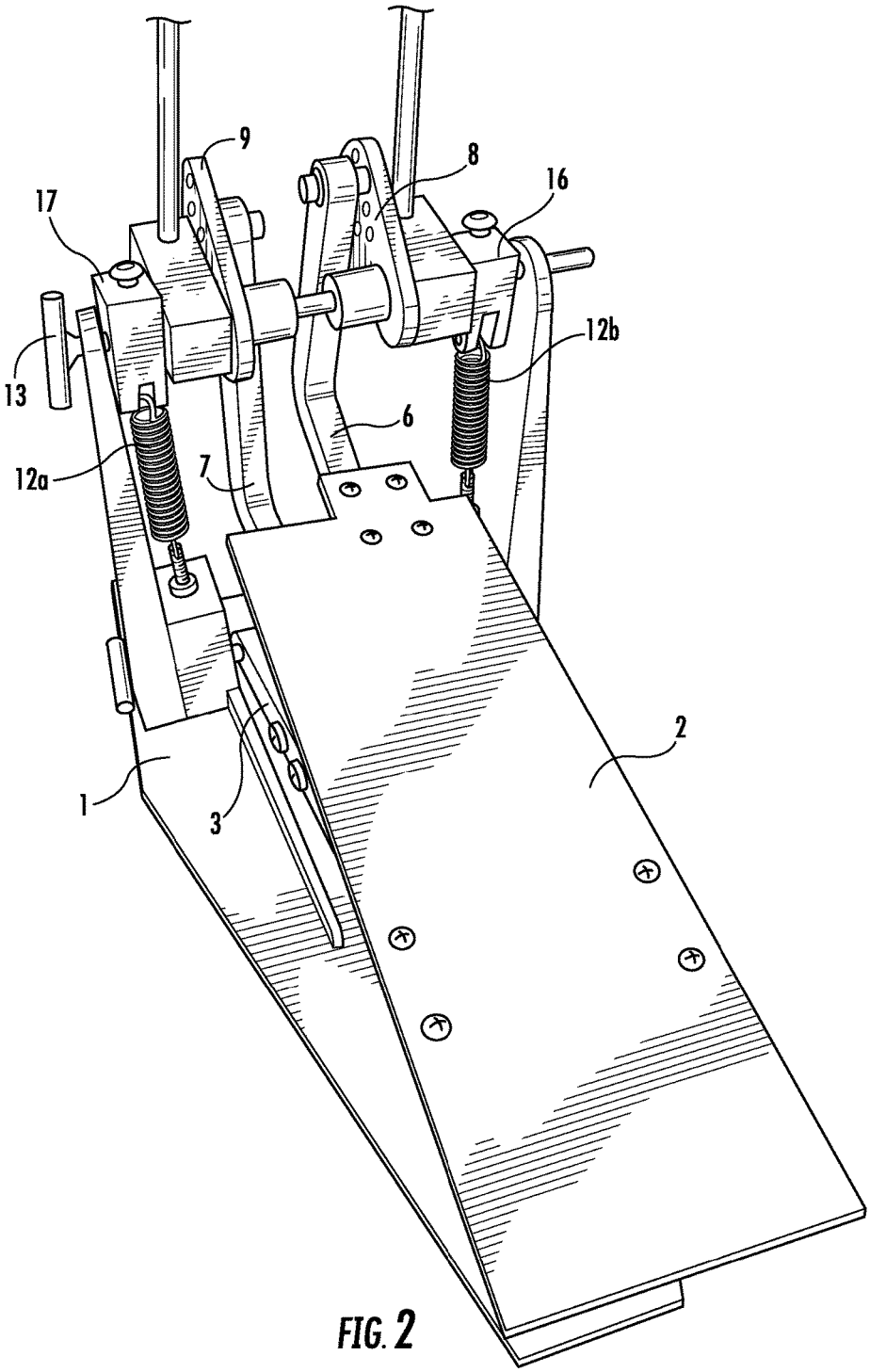
FIG. 2 is a rear perspective view of the embodiment of FIG. 1.
Figure 3:
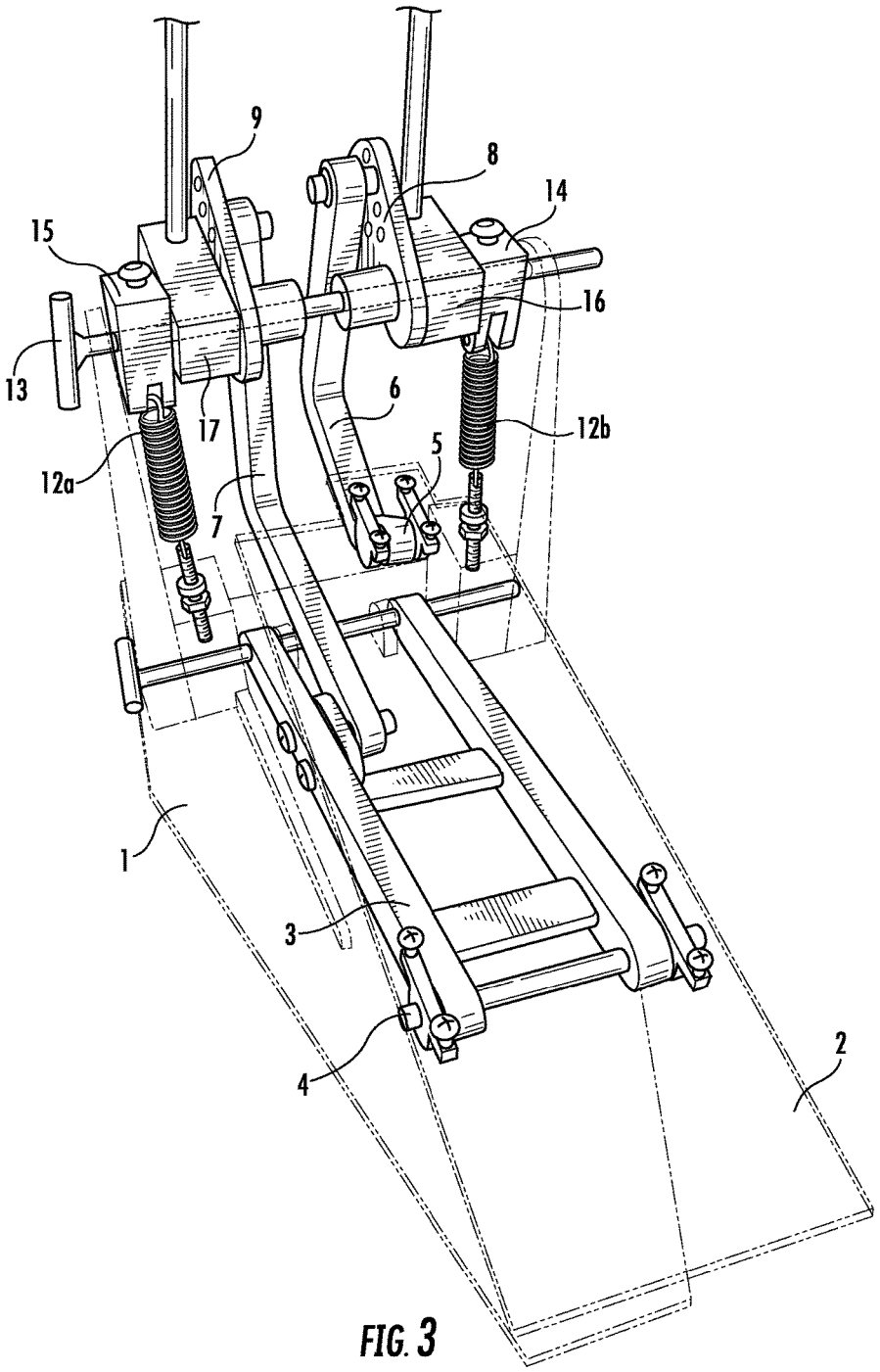
FIG. 3 is a rear perspective view of the embodiment of FIG. 1.
Figure 4:
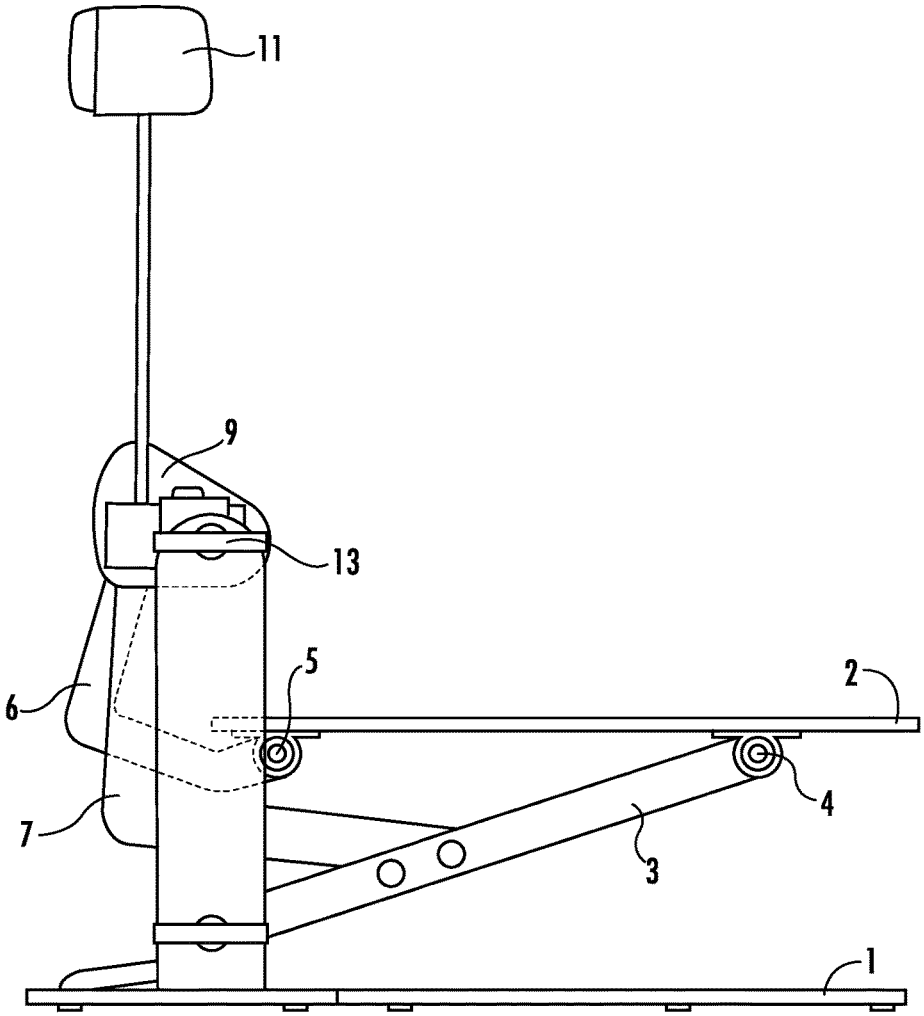
FIG. 4 is a side view of the embodiment of FIG. 1.

The embodiments will now be described more fully hereinafter with reference to the FIGS. 1-7, in which embodiments are shown by way of illustration and example. The invention may, however, be embodied in many forms and should not be construed as limited to the embodiments set forth herein. Rather, these embodiments are provided so that this disclosure will be thorough and complete, and will fully convey the scope of the invention to those skilled in the art. Like numerals refer to like elements.

In the description below, the words "rear" and "front" are used to describe the longitudinal locations on the single contiguous pedal 2. The term "rear" is used to describe the end of the pedal 2 that is located away from the bass drum (not shown) and actuated by a heel of a player. The term "front" is used to describe the opposite end of the pedal 2 that is located near the bass drum, and actuated by the toe of the player.

With reference initially to FIGS. 1-4, one embodiment of the invention is herein described, by way of example, as a bass drum pedal system that includes a base 1 and a single, substantially-contiguous pedal 2. The pedal 2 has a heel hinge point 4 and a toe hinge point 5. The rear of the pedal 2 attaches to one end of a heel transfer arm 3 via the heel hinge point 4. The other end of the heel transfer arm 3 is pivotally connected to the base 1. The hinge points can be implemented with bearings or simple pins, but in any event, these hinge points preferably work like hinges, and are not inflexible attachment points. When the rear portion of the pedal 2 is depressed by the player's heel, motion is coupled through the heel transfer arm 3 and to a heel rocker pivot 9 via a heel linkage 7 to move a heel beater assembly 11. When the front portion of the pedal 2 is depressed by the player's toe, motion is coupled through a toe linkage 6 to a toe rocker pivot 8 to move a toe beater assembly 10.

Figure 5:
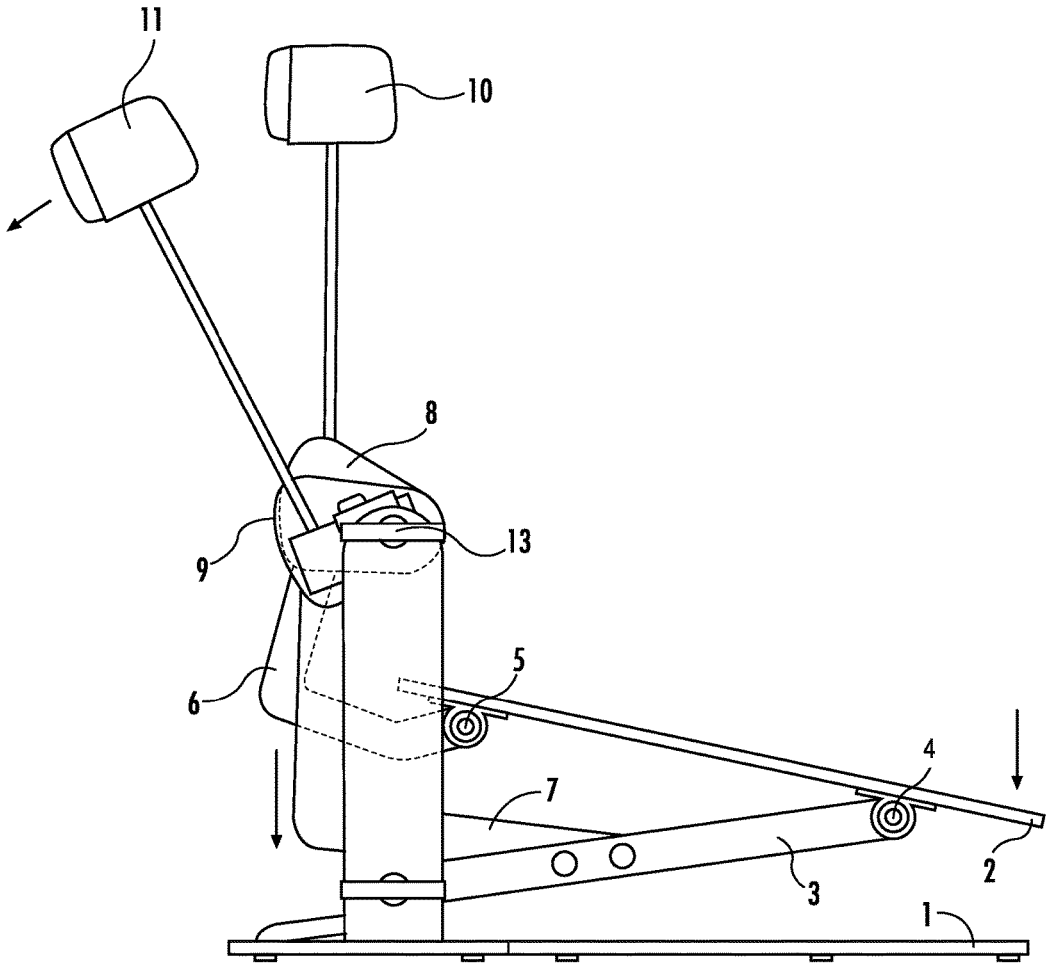
FIG. 5 is a side view of the embodiment of FIG. 1 depicting the heel-actuated movement of the heel beater assembly.
Figure 6:
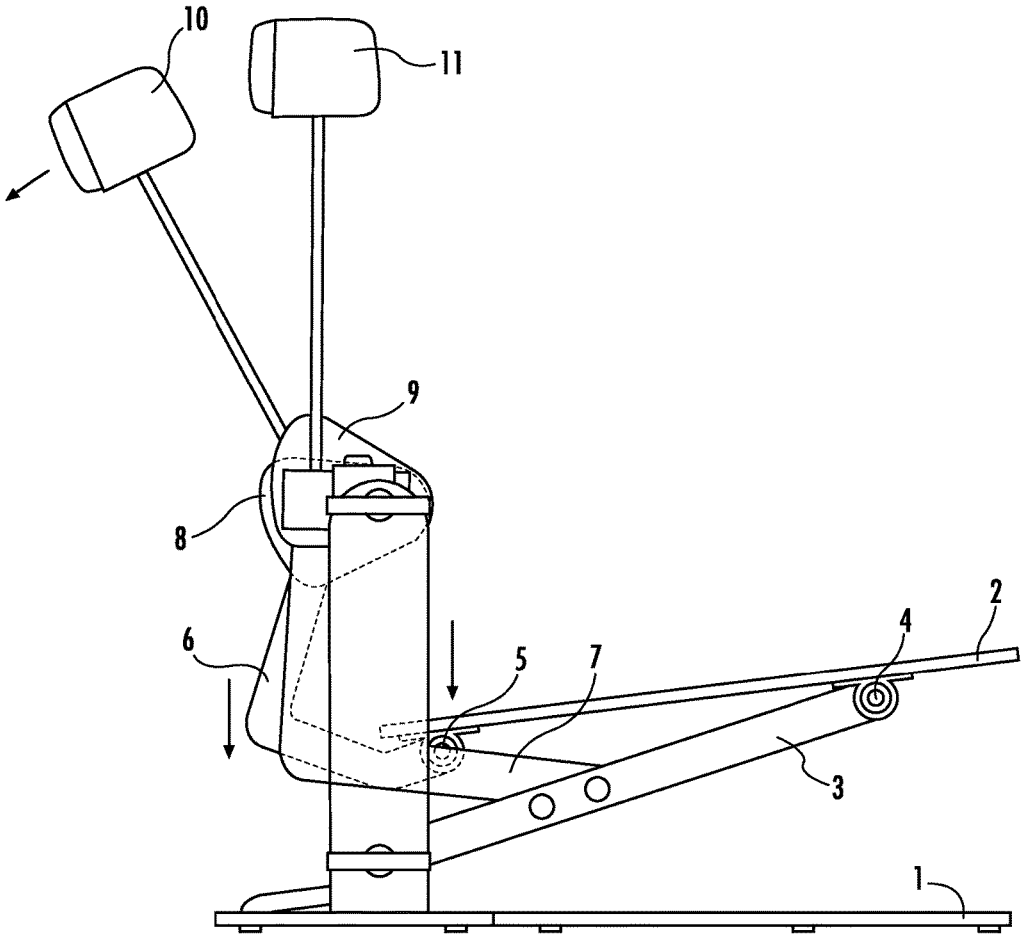
FIG. 6 is a side view of the embodiment of FIG. 1 depicting the toe-actuated movement of the toe beater assembly.
Figure 7:
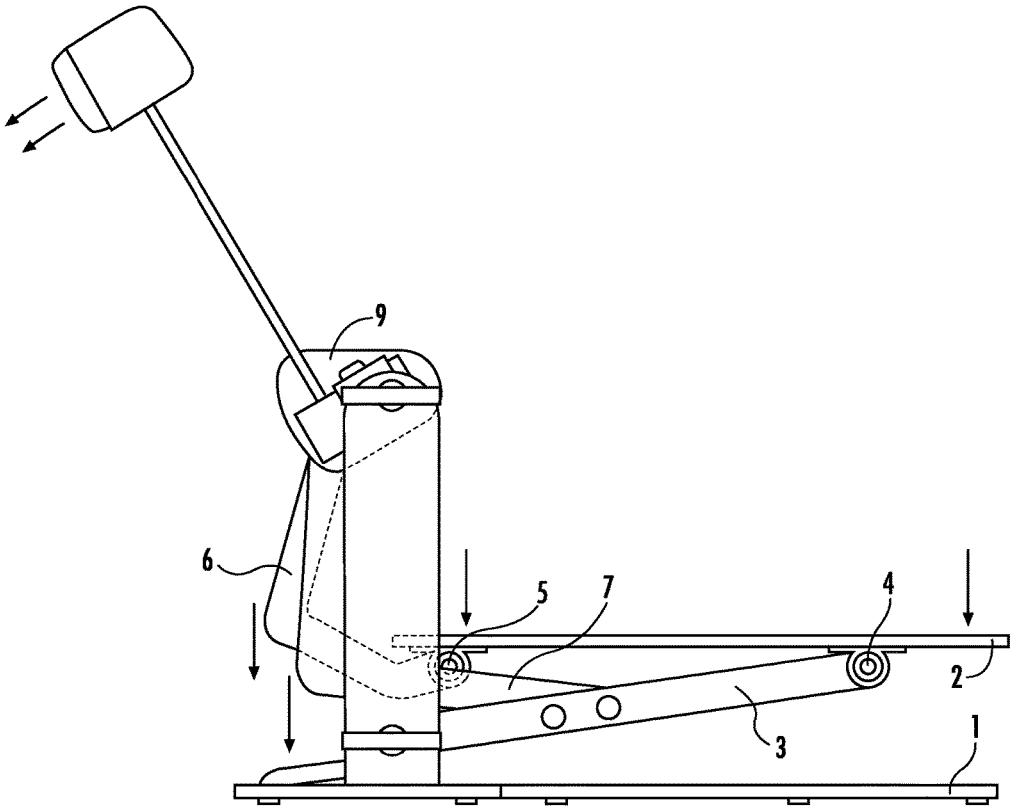
FIG. 7 is a side view of the embodiment of FIG. 1 depicting the simultaneous actuation of both the heel and toe beater assemblies.

As depicted in FIG. 5, depression of the rear of the pedal 2 by a player causes a downward movement of the lower portion of the heel linkage 7, which thus results in a downward pulling of the heel rocker pivot 9 to cause the heel beater assembly 11 to be driven forward toward a drum, drum pad or the like. As depicted in FIG. 6, depression of the front of pedal 2 by a player causes a downward movement of the lower portion of the toe linkage 6, which thus results in a downward pulling of the toe rocker pivot 8 to cause the toe beater assembly 10 to be driven forward toward a drum, drum pad or the like. As depicted in FIG. 7, depression of both the front and heel portions of pedal 2 results in the simultaneous rotation of the toe 8 and heel 9 rocker pivots and a subsequent simultaneous forward movement of both the toe 10 and heel 11 beater assemblies. Accordingly, a player may alter the timing with which the toe 10 and heel 11 beater assemblies strike a drum, drum pad, or the like by varying the angle at which the pedal is depressed, thereby enabling a player to achieve a "flam" effect with a single foot.

In a typical environment, the heel rocker pivot 9 conveys motion to a heel beater assembly 11 which may then strike a bass drum (not shown). Likewise in a typical environment, the toe rocker pivot 8 conveys motion to a toe beater assembly 10 which may then strike a bass drum (not shown). The heel rocker pivot 9 and toe rocker pivot 8 essentially turn linear motion into rotary motion and so these are implemented using bearings or bushings.

Return springs 12*a*, 12*b* return the rocker pivots 10, 11 to a nominal rest position which is located away from the bass drum. These return springs may be implemented internal to the base 1 (for example using compression springs and cams) or may be implemented external to the base 1 (for example as expansion springs attached to the base 1 and to the heel rocker pivot 9 and toe rocker pivot 8.

The toe linkage 6 can be implemented as a single, solid member (for example a plastic or metal strut) or it can be implemented as a flexible member (for example as a belt or chain). Likewise the heel linkage 7 can be implemented as a flexible member (for example as a belt or chain).

When the toe linkage 6 is implemented as a flexible member, the toe rocker pivot 8 may work like a cam, and may have a non-circular cross section which allows for a nonlinear relationship between pedal depression and toe beater travel. This may be desirable so as to accelerate the toe beater assembly 10 toward the drum during actuation.

Likewise, when the heel linkage 7 is implemented as a flexible member, the heel rocker pivot 9 may work like a cam, and may have a non-circular cross section which allows for a non-linear relationship between pedal depression and toe beater travel. This may be desirable so as to accelerate the heel beater assembly 11 toward the drum during actuation.

The pedal 2 may be implemented as a solid piece of material (such as plastic or metal) or it may involve "segments" that allow for the expansion and contraction of longitudinal pedal length (a telescoping pedal), thus allowing the pedal 2 to accommodate different player foot sizes.

The heel hinge point 4 may be located at the rearmost end of the pedal 2 or, as illustrated in FIGS. 1-7, located somewhat forward from the rearmost end—essentially allowing the pivot to occur in the middle of the heel of the player's foot. Likewise the toe hinge point 5 may be located at the front-most location of the pedal, or alternatively somewhat rearward—essentially allowing the pivot to occur at the ball of the foot.

It will be understood by those of skill in the art, now having the benefit of the teachings of the present invention, that a player could use the pedal without either the heel beater assembly 11 or toe beater assembly 10. For example, the player could omit the heel beater assembly 11 and actuate the bass drum using only toe motion. Although the player would not benefit from the heel-toe aspects of the present invention, the player may still benefit from the improved ergonomics of the pedal invention. Likewise, a player could omit the toe beater assembly 10 for the same benefit.

When being used without the heel beater assembly 11, the heel rocker pivot 9 could be coupled to an external linkage through an attachment point 13. For example, heel rocker pivot 9 and heel rebound cam 15 may be coupled via attachment point 13 to an external linkage. The external linkage could convey the motion to a separate pedal to actuate a separate bass drum or other percussive instrument (not shown), as is often done with "double-bass" arrangements. In this way player toe motion would actuate the main bass drum, and player heel motion would actuate a secondary sound or effect. The same can be said about use without the toe beater assembly 10.

In some instances, embodiments of the present invention may be used with electronic drums or acoustic drums. Electronic drums are instruments that do not make much sound when actuated and instead they merely "trigger" a drum sound via electronics. Some electronic drum sets use a drum pad, as illustrated with reference again to FIG. 2. wherein a trigger is located internally to the pad. Other electronic drum sets do not use pads, and merely implement the triggering means directly on a pedal.

Embodiments of the invention may be used directly with electronic drums that use a drum pad in a similar way to how the present invention would be used with and acoustic drum. The drum beaters 10, 11 directly strike the drum pad, causing it to trigger the electronic sound.

Alternatively triggers can be implemented, either as a part of the toe beater assembly 10 and heel beater assembly 11, or attached to the base 1 and triggered by direct contact of the pedal 2 beater assembly 11, or attached to the base 1 and triggered by direct contact of the pedal 2. Actuators may be included within the rocker pivots, by way of example.

The initial height of the pedal 2 relative to the base 1 can be adjusted by or a combination of the following: rotating the heel rocker pivot 9, adjusting the length of the heel linkage 7, or by adjusting the location of the connection between the heel linkage 7, and the heel transfer arm 3.

The initial angle of the pedal 2 relative to the base 1 can be adjusted by a combination of the following: rotating the heel rocker pivot 9, adjusting the length of the heel linkage 7, by adjusting the location of the connection between the heel linkage 7, and the heel transfer arm 3, by rotating the toe rocker pivot 8, adjusting the length of the toe linkage 6, or by adjusting the location of the toe hinge point 5.

The initial toe beater angle can be adjusted by adjusting the orientation of a toe rebound cam 14 relative to a toe beater holder 16 via a clamping system, interlocking system, or a pinning system.

The initial heel beater angle can be adjusted by adjusting the orientation of a heel rebound cam 15 relative to a heel beater holder 17 via a clamping system, interlocking system, or a pinning system.

The rebound rate of the toe beater can be independently adjusted via the toe adjustment knob. A preload can be applied to the spring, which pushes on the push rod harder, making the pedal require more force to depress, but has more energy to rebound at a faster rate. In one embodiment, the toe adjustment knob comprises a threaded component that is attached to an end of the spring. Thus, the rebound rates of the toe beaters can be independently adjusted by adjusting the tension of spring 12*b*.

The rebound rate of the heel beater can be independently adjusted via the heel adjustment knob. A preload can be applied to the spring, which pushes on the push rod harder, making the pedal require more force to depress, but has more energy to rebound at a faster rate. In one embodiment, the heel adjustment knob comprises a threaded component that is attached to an end of the spring. Thus, the rebound rate of the heel beater can be independently adjusted by adjusting the tension of spring 12*a*.

To aid in pedal to pedal consistency during manufacture and use, indicator marks may be incorporated into parts to allow for a comparison of any adjustment between the toe and heels side, as well as between other pedals.

The internal springs can have grease applied to reduce wear and friction between the springs, the base, the push rods, and the cams. A benefit of this is damping as added to the systems, allowing for the pedal to not oscillate.

The toe is configurable by end user to operate in different linkage sub-assemblies. Sub-assemblies of the toe rocker pivot and the toe linkage can be interchanged by the end user between a solid linkage or a flexible linkage, or different size components, allowing for different initial setups to be customized to the end users' needs.

Independently, the heel is configurable by end user to operate in different linkage sub-assemblies. Sub-assemblies of the toe rocker pivot and the toe linkage can be interchanged by the end users between a solid linkage or a flexible linkage.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A heel-toe actuated pedal system, the system comprising:

a base;

a pedal having a heel hinge point proximate a rear portion thereof and an opposing toe hinge point proximate a front portion thereof;

a heel transfer arm pivotally connected at a first end thereof to the heel hinge point of the pedal and at a second end thereof to the base;

a heel rocker pivot rotatably connected to the base at an upstanding portion thereof and in a spaced relation to the heel transfer arm second end;

a heel linkage pivotally connected at opposing ends thereof to the transfer arm second end and the heel rocker pivot, wherein movement of the heel linkage provides rotational movement to the heel rocker pivot;

a toe rocker pivot rotatably connected to the upstanding portion of the base;

a toe linkage pivotally connected at opposing ends thereof to the toe rocker pivot and the toe hinge point of the pedal, wherein movement of the toe linkage provides rotational movement to the toe rocker pivot; and at least one return spring operable with the rocker pivots, wherein the rocker pivots are biased toward a preselected rotation.

2. The pedal system according to claim 1, further comprising a heel beater assembly operable with the heel rocker pivot, wherein rotation of the heel rocker pivot resulting from movement of the rear portion of the pedal results in the heel beater assembly interacting with a sound element.

3. The pedal system according to claim 2, wherein the heel beater assembly comprises a beater arm operable with the heel rocker pivot at a first end thereof and a beater pad carried at a second opposing end thereof.

4. The pedal system according to claim 1, wherein the heel linkage comprises a rigid member.

5. The pedal system according to claim 1, wherein the heel linkage comprises a flexible member.

6. The pedal system according to claim 1, further comprising a toe beater assembly operable with the toe rocker pivot, wherein rotation of the toe rocker pivot resulting from movement of the front portion of the pedal results in the toe beater assembly interacting with a sound element.

7. The pedal system according to claim 6, wherein the toe beater assembly comprises a beater arm operable with the toe rocker pivot at a first end thereof and a beater pad carried at a second opposing end thereof.

8. The pedal system according to claim 1, wherein the toe linkage comprises a rigid member.

9. The pedal system according to claim 1, wherein the toe linkage comprises a flexible member.

10. The pedal system according to claim 1, wherein the heel hinge point is located at the rear-most location of the pedal.

11. The pedal system according to claim 1, wherein the heel hinge point is distanced from the rear-most location of the pedal.

12. The pedal system according to claim 1, wherein the toe hinge point is located at the front-most location of the pedal.

13. The pedal system according to claim 1, wherein the toe hinge point is distanced from the front-most location of the pedal.

14. The pedal system according to claim 1, wherein the heel rocker pivot has a non-circular cross section thereby affecting a nonlinear relationship between pedal motion and heel beater assembly motion.

15. The pedal system according to claim 1, wherein the toe rocker pivot has a non-circular cross section thereby affecting a nonlinear relationship between pedal motion and toe beater assembly motion.

16. A heel-toe actuated pedal system, the system comprising:

a base;

a contiguous pedal having a first hinge point at a rear portion thereof and a second hinge point at a front portion thereof;

a heel transfer arm pivotally connected at a first end thereof to the heel hinge point of the pedal and at a second end thereof to the base;

a heel rocker pivot rotatably connected to the base at an upstanding portion thereof;

a heel linkage pivotally connected at opposing ends thereof to the transfer arm second end and the heel rocker pivot, wherein linear movement of the heel linkage provides rotational movement to the heel rocker pivot;

a toe rocker pivot rotatably connected to the upstanding portion of the base; and a toe linkage pivotally connected at opposing ends thereof to the toe rocker pivot and the toe hinge point of the pedal, wherein linear movement of the toe linkage provides rotational movement to the toe rocker pivot, wherein depressing the front portion of the contiguous pedal results in rotation of the toe rocker pivot, wherein depressing the rear portion of the contiguous pedal results in rotation of the heel rocker pivot, and wherein simultaneously depressing both the front and rear portions of the contiguous pedal results in rotation of both the toe and heel rocker pivots.

* * * * *